US005188036A

United States Patent [19]

Di Rosa

[11] Patent Number: 5,188,036

[45] Date of Patent: Feb. 23, 1993

[54] SUSPENSION DEVICE FOR OVERHEAD TRACKS WITH L-SHAPED ELASTIC CLAMPS FOR ENGAGING GROOVES ON THE RAILS AND CLAMPING THE RAILS TO THE SUSPENSION DEVICE

[75] Inventor: Gaetano Di Rosa, Pino Torinese, Italy

[73] Assignee: Fata Automation S.p.A., Turin, Italy

[21] Appl. No.: 800,323

[22] Filed: Dec. 3, 1991

[51] Int. Cl.[5] ..... E01B 25/24

[52] U.S. Cl. ..... 104/111; 238/310/338

[58] Field of Search ..... 104/106, 109, 111; 238/310, 338, 342, 344, 345, 349, 352, 364

[56] References Cited

U.S. PATENT DOCUMENTS

| | | | |
|---|---|---|---|
| 1,759,213 | 5/1930 | Webb | 104/111 |
| 4,646,647 | 3/1987 | Spöler et al. | 104/111 |
| 4,798,146 | 1/1989 | Roetzel | 104/111 |
| 4,928,602 | 5/1990 | Duczkowski, Jr. et al. | 104/111 |

FOREIGN PATENT DOCUMENTS

| | | | |
|---|---|---|---|
| 3533835 | 11/1986 | Fed. Rep. of Germany | 104/111 |
| 571539 | 9/1977 | U.S.S.R. | 104/111 |

*Primary Examiner*—Robert J. Oberleitner
*Assistant Examiner*—S. Joseph Morano
*Attorney, Agent, or Firm*—Finnegan, Henderson, Farabow, Garrett & Dunner

[57] ABSTRACT

An assembly (10) for supporting suspended elements (14), such as the tracks of a monorail system for the suspended movement of powered trolleys. The assembly includes a supporting hanger (11) connected at one end to a supporting beam (12) and having at the other end a plate (13) that is received between the flanges of a piece of track. The tracks are pulled tight against the plates of the hangers by a pair of elastic members (17, 18) that are secured to the hanger by a nut and bolt arrangement (24) and are leveraged against the inside of grooves (16, 23) in the flanges of the tracks to secure them elastically to the hangers.

6 Claims, 2 Drawing Sheets

Fig. 2
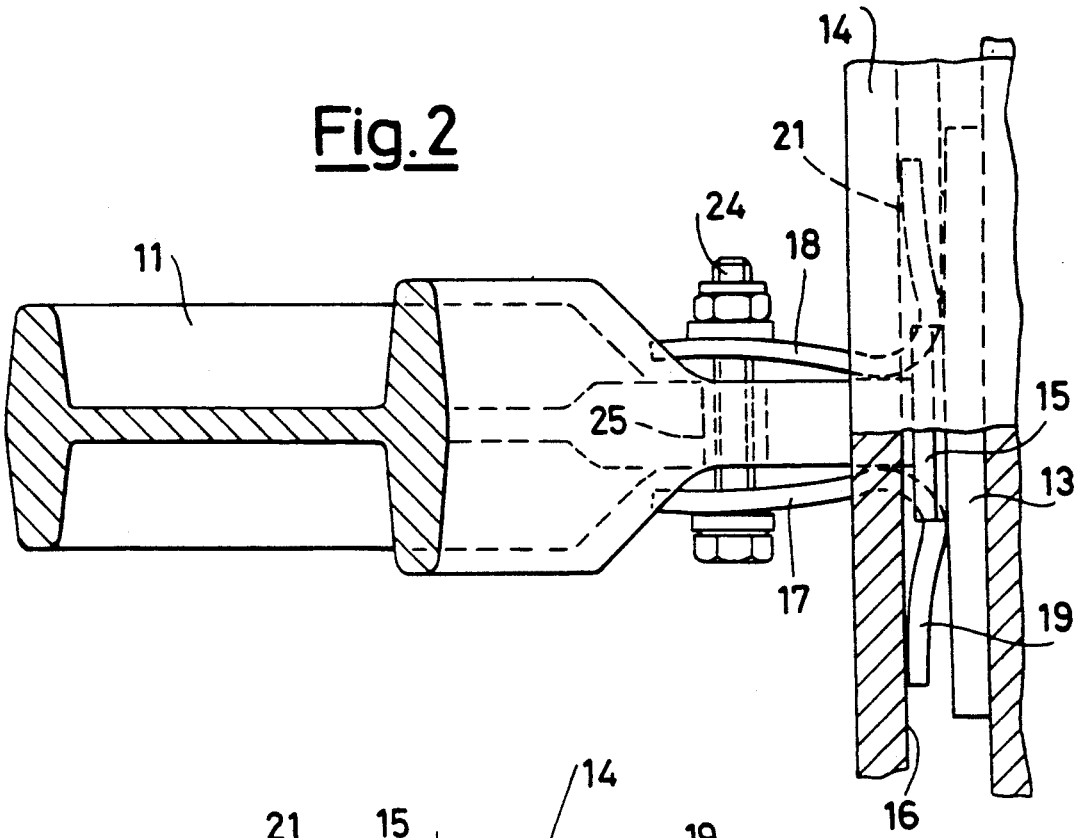
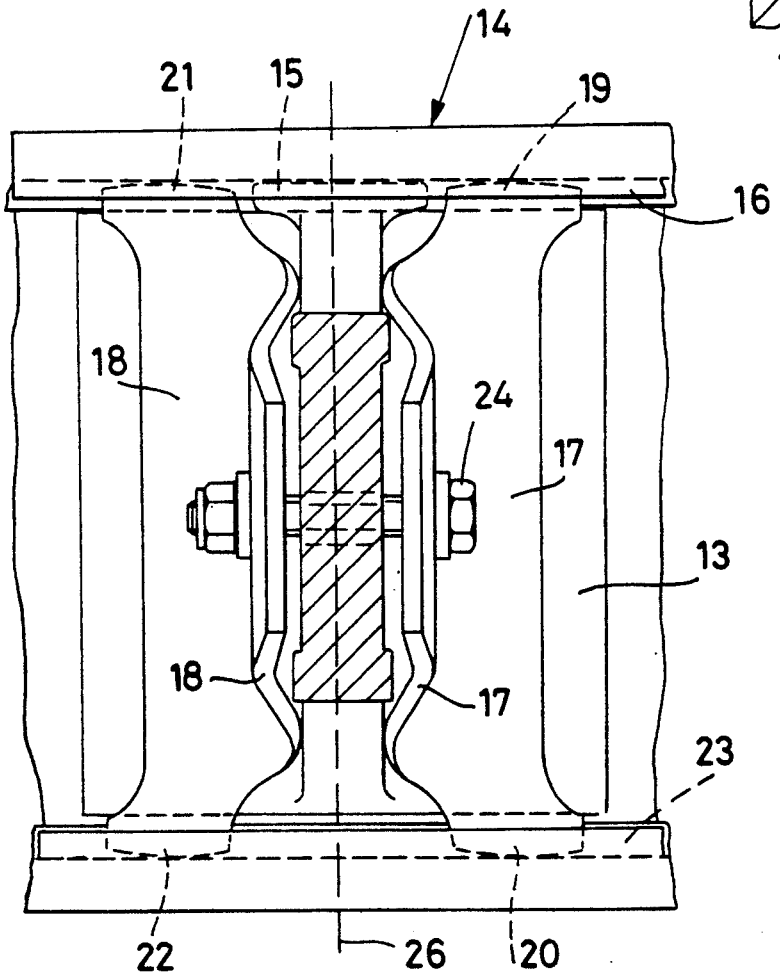
Fig. 3

SUSPENSION DEVICE FOR OVERHEAD TRACKS WITH L-SHAPED ELASTIC CLAMPS FOR ENGAGING GROOVES ON THE RAILS AND CLAMPING THE RAILS TO THE SUSPENSION DEVICE

BACKGROUND OF THE INVENTION

The present invention relates to a device for coupling to a support a suspended rail of the type used in material handling systems with overhead track, e.g. with powered trolleys for the conveyance of materials in factories. Usually the supports hang from above and are made up of a hanger at the lower end of which there is present a plate for securing the rail to it with bolts. To seek to improve safety and ease of assembly, there have been proposed hangers having also support means for the rail by simply resting it thereon and requiring bolting to ensure steady positioning on said means. In this manner upon assembly it is sufficient to rest the various sections of the track on the supports and subsequently bolt them together.

But the requirement remains to bolt the supports and rails together, which requires drilling of the rails at each support, complicating installation and increasing costs. Attempts to avoid fastenings which require drilling of the rails have had little success and produce anchoring which, because it does not distribute uniformly the fastening stresses, create zones of excessive stresses with the danger of sudden failure and/or deformation and high wear.

In addition the existing supports always use rigid fastenings between the rail and support and do not permit absorption of the stresses generated by passage of the trolleys along the track, producing stresses which, in the long run, result in deformation and wear of the various elements. This wear further increases unavoidable play between the parts and further hastens the wearing process and also increases the noise produced by the system.

The general object of the present invention is to obviate the above mentioned shortcomings by providing supporting elements for overhead tracks which do not require drilling of the rails, are fast and easy to install, and supply an effectively elastic system with absorption of anomalous stresses and recovery of play between support and rail with simultaneous uniform distribution of stresses.

SUMMARY OF THE INVENTION

In accordance with the present invention, a supporting element is provided for suspended elements having a cross section presenting substantially a vertical web and two spaced horizontal flanges, in particular forming tracks of the monorail type for the suspended movement of powered trolleys, comprising a supporting hanger connected at one end to the suspended element and characterized in that the end of the support terminates with a plate with a rear surface connected normal thereto. At least one suspended element rests with one flange on the upper edge of the plate to receive it between the flanges, so that it adheres with its front surface to the vertical web, there being provided also engagement elements shaped generally like the letter L and arranged on two opposite sides of the end of the supporting element to have first arms substantially parallel to said end and second arms, directed oppositely, substantially parallel to said plate to engage in a position near the end in opposing grooves placed facing on the flanges. A traction screw interconnecting the parallel arms of the engagement elements draws said parallel arms near upon tightening of the screw causing an opposed pivoting movement of said engagement elements on the sides of the end of the supporting element, said engagement elements applying leverage upon the pivoting movement between the outer wall of the grooves and the rear surface of the plate to press the web of the suspended element against the front surface of the plate.

BRIEF DESCRIPTION OF THE DRAWINGS

To further clarify the explanation of the present invention and its advantages as compared with the known art, there is described below with the aid of the drawings an embodiment as a nonlimiting example applying said principles. In the drawings FIG. 2 is a cross sectional view of the support taken along the line II—II of FIG. 1, FIG. 3 is a cross sectional view of the support taken along the line III—III of FIG. 1.

DETAILED DESCRIPTION OF THE INVENTION

Figure 1:
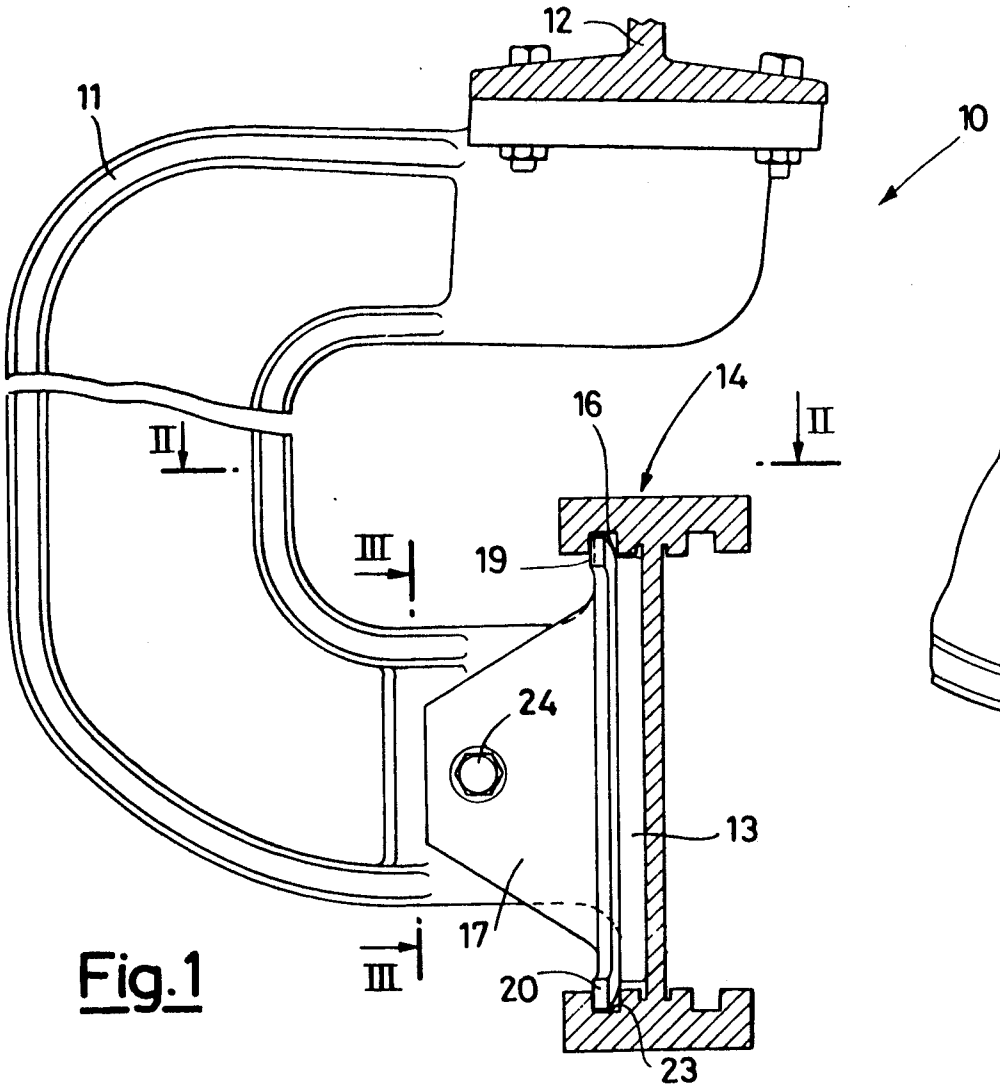
FIG. 1 shows schematically a side view of a support applying the principles of the present invention.

With reference to the drawings a support indicated generally by reference number 10 comprises, as may be clearly seen in FIG. 1, a hanger 11 fastened above to a supporting beam 12.

The hanger 11 terminates at its lower end with a vertical plate 13 on which rests on the top and side thereof, a track represented by a rail 14 shaped like the letter I with parallel horizontal flanges and a central web.

Figure 4:
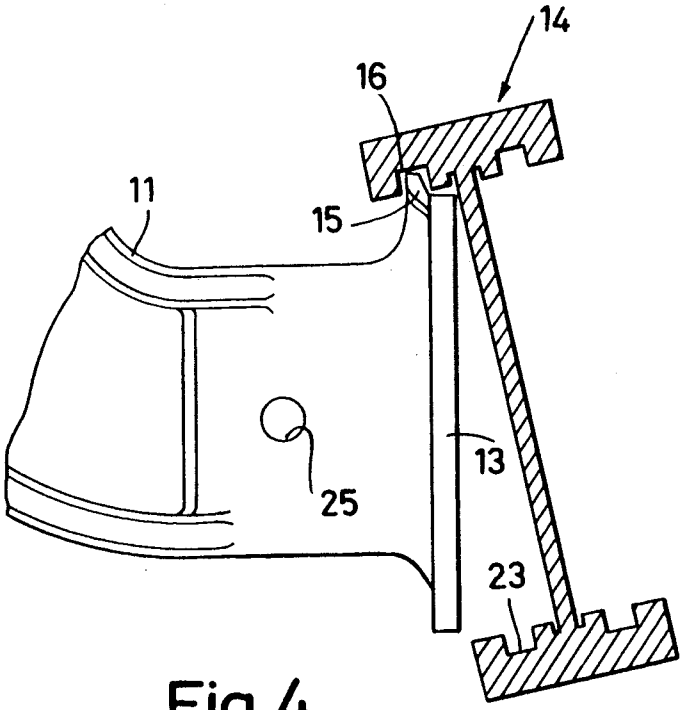
FIG. 4 shows a partial side view of the support of FIG. 1 during installation.

As may be seen also in FIG. 4, the lower end of the hanger 11 has near the plate 13 a tooth 15 which fits in a groove 16 in the upper flange of rail 14 open from below and running parallel to the longitudinal length of the rail for anchoring against sliding movement.

Laterally of the lower end of the hanger 11 are two members 17 and 18 respectively shaped generally like the letter L and preferably of elastic material, e.g. made of steel laminate. As best seen in FIG. 1 and in particular in FIG. 3, the elastic members have on their arms nearest the track and extending substantially along the plate 13, projecting parts 19, 20 on member 17 and projecting parts 21, 22 on member 18. These parts engage with the top and outer side wall of the groove 16 and at the bottom and outer side wall of a similar groove 23 in the lower flange of rail 14.

The other arm of each elastic member 17, 18 extends along the side surface of the lower terminal part of the hanger. Said other arms are interconnected by a bolt 24 passing through a hole 25 in the hanger 11.

As best seen in FIG. 2 the elastic members 17 and 18 are advantageously formed like a continuous curve without sharp bends.

In use there are present a plurality of supports 10 arranged with appropriate spacing to support a plurality of rail segments to form the track. To install the rail segments on their respective supports, each segment is rested on the terminal ends of the respective hangers by inserting its tooth 15 of the hanger in the groove 16 by means of an inclined movement as shown in FIG. 4, until the central web of the rail rests on the outer face of the plate 13. Such an operation is easily and rapidly performed and once completed the rail remains in place without danger of falling. To secure the rail to each support it suffices then to insert in each support with a slight rotation in the plane of FIG. 3, the elastic members 17, 18 with the engagement parts 19, 20, 21, 22 (advantageously arched to facilitate said rotation as may be seen in FIG. 3) into the respective grooves 16, 23 and then to tighten bolt 24 so that drawing in of the arms extending along the hanger causes thrust at the ends of the other arms against the outermost wall of the grooves 16 and 23. This presses the outermost face of the plate 13 against the central web of the rail as may be better seen in FIG. 2.

In this manner a substantially uniform force between the plate and the web generates sufficient friction to firmly hold the rail to the support.

To splice two rail segments together, it suffices to place in the median position of the plate 13, the facing ends of the segments as shown schematically by the line 26 in FIG. 3 so that each of the two elastic members acts on the end of a segment. Advantageously the bolt 24 should not be completely tight so as to allow elastic movement of the members 17 and 18. (See FIG. 2) In addition, by providing the two L arms of the elastic members of different length and in particular the arms involved with the bolt longer, the force supported by said bolt is less than the corresponding force generated on the track.

It is now clear that fastening of the track no longer requires drilling of the rails and thus permits installation at any point on the rail without any special preparation. At the same time the fastening is easier and faster because of the ability to merely hang the rail on the support before fastening it permanently.

In addition the forces generated by the fastening system on the rail are distributed and are substantially symmetrical so as to avoid forces which would lead to rapid wear and failure.

Finally the fastening is sufficiently elastic to allow absorption of the stresses generated by passage of the trolleys along the rails and at the same time allows recovery of play.

Naturally the above description of an embodiment applying the innovative principles of the present invention is given merely by way of example and therefore is not to be taken as a limitation thereof. For example, the form of the hanger is only indicative, as is the form of the upper fastening thereof. On this point it is clear that the upper fastening can be of any known type without thereby going beyond the scope of the invention claimed herein.

In addition it is clear that the track can optionally have a cross section different from that shown, e.g. like the letter C.

I claim:

1. An assembly for supporting suspended elements having a substantially vertical web with two parallel spaced horizontal flanges extending perpendicular thereto and having a pair of longitudinally extending, oppositely facing upper and lower grooves in the flanges on at least one side of the web, said assembly comprising a hanger having a lower end that terminates in a vertical plate normal thereto, said plate having a front and rear surface and an upper and lower edge, said upper edge of the plate being insertable into the upper groove of the pair of grooves in the flanges of a suspended element so that the web of said element will rest against the front surface of said plate, a pair of L-shaped members located on opposite sides of the hanger adjacent the plate, each member having a first arm extending substantially parallel to said hanger and a second arm extending perpendicular thereto and away from said hanger substantially parallel to said plate, each of said second arms having an upper and lower edge engagable with said upper and lower grooves, respectively, in the flanges of a suspended element and fastening means for securing said first arms of the L-shaped members to opposite sides of the hanger, whereby tightening of the fastening means causes the second arms of the L-shaped members to draw the web of a suspended element tightly against the front surface of the plate on the lower end of the hanger.

2. The assembly of claim 1, wherein said plate includes a tooth that engages with a suspended element to anchor the element against sliding movement relative to said hanger.

3. The assembly of claim 2, wherein the tooth engages in the upper groove of the flange of an element resting against said plate.

4. The assembly of claim 1, for receiving the abutting ends of two suspended elements, said ends abutting in a median position of said plate, one of each L-shaped members engaging in the respective grooves of one of the two suspended elements.

5. The assembly of claim 1, wherein the L-shaped members are made of an elastic material.

6. The assembly of claim 1, wherein the edges of the second arms of the L-shaped members engagable in the grooves of the elements have an outwardly arched shape.

* * * * *